US009157154B2

(12) United States Patent
Inoue

(10) Patent No.: US 9,157,154 B2
(45) Date of Patent: Oct. 13, 2015

(54) AQUEOUS TREATING SOLUTION FOR FORMING BLACK TRIVALENT-CHROMIUM CHEMICAL CONVERSION COATING ON ZINC OR ZINC ALLOY AND METHOD OF FORMING BLACK TRIVALENT-CHROMIUM CHEMICAL CONVERSION COATING

(75) Inventor: Manabu Inoue, Tokyo (JP)

(73) Assignee: DIPSOL CHEMICALS CO., LTD., Tokyo (JP)

( * ) Notice: Subject to any disclaimer, the term of this patent is extended or adjusted under 35 U.S.C. 154(b) by 323 days.

(21) Appl. No.: 12/200,209

(22) Filed: Aug. 28, 2008

(65) Prior Publication Data

US 2009/0020185 A1 Jan. 22, 2009

Related U.S. Application Data

(63) Continuation of application No. PCT/JP2007/054153, filed on Mar. 5, 2007.

(30) Foreign Application Priority Data

Mar. 3, 2006 (JP) ..... 2006-058050

(51) Int. Cl.

| | |
|---|---|
| ***C23C 22/30*** | (2006.01) |
| *C23C 22/07* | (2006.01) |
| *C23C 22/46* | (2006.01) |
| *C23C 22/83* | (2006.01) |

(52) U.S. Cl.

CPC ..... *C23C 22/30* (2013.01); *C23C 22/46* (2013.01); *C23C 22/83* (2013.01); *C23C 2222/10* (2013.01)

(58) Field of Classification Search

CPC ..... C23C 22/30; C23C 22/33; C23C 2222/10
USPC ..... 148/264–268
See application file for complete search history.

(56) References Cited

U.S. PATENT DOCUMENTS

| | | | | |
|---|---|---|---|---|
| 4,263,059 | A | 4/1981 | Guhde et al. | |
| 5,407,749 | A | 4/1995 | Bishop | |
| 5,415,702 | A | 5/1995 | Bishop et al. | |
| 2009/0032146 | A1* | 2/2009 | Capper et al. | 148/267 |

FOREIGN PATENT DOCUMENTS

| | | | | |
|---|---|---|---|---|
| DE | 10305450 | * | 8/2004 | C23C 22/34 |
| EP | 0 587 543 | B1 | 1/1997 | |
| GE | 10305450 | * | 8/2004 | C23C 22/53 |
| JP | 6315991 | | 8/1981 | |
| JP | 8-152293 | A | 6/1996 | |
| JP | 08239776 | | 9/1996 | |
| JP | 8-296053 | A | 11/1996 | |
| JP | 10183364 | | 7/1998 | |
| JP | 2000054157 | | 2/2000 | |
| JP | 2000509434 | | 7/2000 | |
| JP | 2003268562 | | 9/2003 | |
| JP | 2005187925 | | 7/2005 | |
| JP | 2005-206872 | * | 8/2005 | C23C 22/30 |
| JP | 2005206872 | | 8/2005 | |

OTHER PUBLICATIONS

Office Action issued to Japanese Patent Application No. 2008-502881, mailed on Sep. 10, 2012.

* cited by examiner

*Primary Examiner* — Lois Zheng

(74) *Attorney, Agent, or Firm* — Hoffmann & Baron, LLP

(57) ABSTRACT

A treating solution for forming on a surface of either zinc or a zinc alloy a hexavalent-chromium-free trivalent-chromium chemical conversion coating which has an even black appearance and satisfactory corrosion resistance. The treating solution has a long treating-bath life. Also provided is a method of forming a black trivalent-chromium chemical conversion coating. The aqueous treating solution, which is for forming a black trivalent-chromium chemical conversion coating on zinc or a zinc alloy, contains trivalent chromium ions, a phosphoric ester and/or phosphorous ester, and a sulfur compound. The method is a method of chemically treating zinc or a zinc alloy which comprises using the aqueous treating solution to chemically treat the zinc or zinc alloy at a solution temperature of 10-60° C., whereby a black trivalent-chromium chemical conversion coating is formed on the zinc or zinc alloy. Furthermore provided is a coated zinc or zinc alloy metal which comprises zinc or a zinc alloy and, formed thereon, a black trivalent-chromium chemical conversion coating formed by a chemical treatment with the aqueous treating solution.

3 Claims, 1 Drawing Sheet

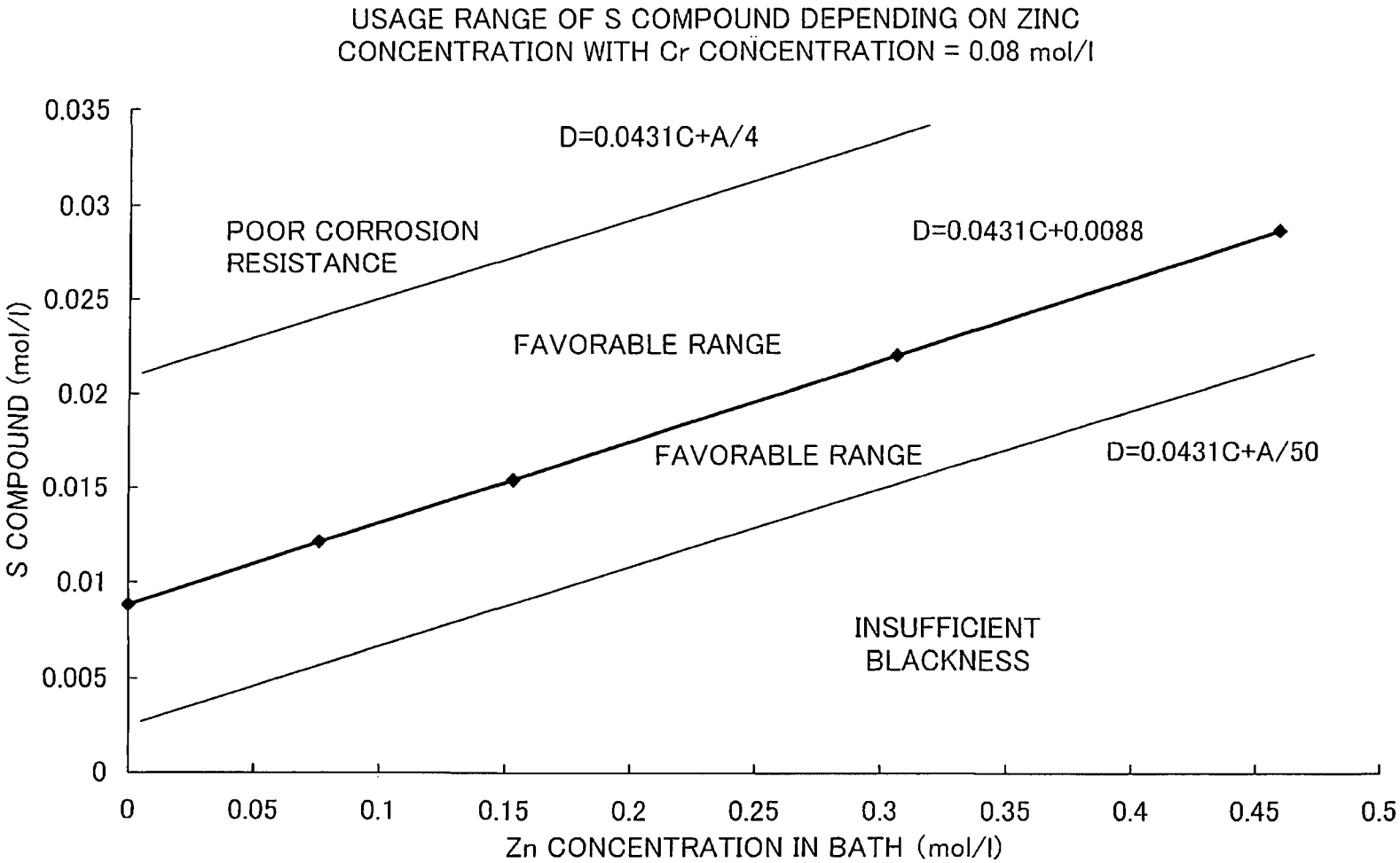
USAGE RANGE OF S COMPOUND DEPENDING ON ZINC CONCENTRATION WITH Cr CONCENTRATION = 0.08 mol/l
D=0.0431C+A/4
D=0.0431C+0.0088
D=0.0431C+A/50
POOR CORROSION RESISTANCE
FAVORABLE RANGE
FAVORABLE RANGE
INSUFFICIENT BLACKNESS
S COMPOUND (mol/l)
0.035
0.03
0.025
0.02
0.015
0.01
0.005
0
0
0.05
0.1
0.15
0.2
0.25
0.3
0.35
0.4
0.45
0.5
Zn CONCENTRATION IN BATH (mol/l)

AQUEOUS TREATING SOLUTION FOR FORMING BLACK TRIVALENT-CHROMIUM CHEMICAL CONVERSION COATING ON ZINC OR ZINC ALLOY AND METHOD OF FORMING BLACK TRIVALENT-CHROMIUM CHEMICAL CONVERSION COATING

CROSS-REFERENCE TO RELATED APPLICATIONS

This application is a continuation of International Application No. PCT/JP2007/054153, filed Mar. 5, 2007, which claims priority to Japanese Patent Application No. 2006-058050, filed Mar. 3, 2006, the contents of each of which are incorporated herein by reference.

TECHNICAL FIELD

The present invention relates to an aqueous treatment solution for forming, on the zinc or zinc alloy surface, a hexavalent chromium-free black trivalent chromium chemical conversion coating film with a uniform black and bright appearance and a good corrosion resistance, and a method for forming the black trivalent chromium chemical conversion coating film.

BACKGROUND ART

Recently, a method using zinc or zinc alloy plating has been widely employed as a method for inhibiting corrosion of the surface of a metal. However, plating by itself will not provide a sufficient corrosion resistance, and thus a chromic acid treatment after plating, that is, a so-called chromate treatment, has been widely employed in industry. On the other hand, it has been pointed out that hexavalent chromium harms human bodies and the environment, and, as a result, moves to regulate the use of hexavalent chromium have gained momentum. An alternative to a coating film formed with hexavalent chromium is a rust preventive coating film in which trivalent chromium is used. For example, Patent Article 1 discloses a treatment method using a mixture of trivalent chromium, a fluoride, an organic acid, an inorganic acid and a metal salt such as cobalt sulfate. However, this bath has environmental problems since a fluoride is used in the bath. Meanwhile, Patent Article 2 proposes hexavalent chromium-free rustproofing in which a phosphoric acid, a salt of a metal such as Mo, $Cr^{3+}$ or Ti, and an oxidant are used. However, in this method there is still a possibility that trivalent chromium will be oxidized into hexavalent chromium, because of using a large amount of an oxidant.

Patent Article 3 proposes a chemical conversion treatment in which phosphorus, a metal such as Mo, and trivalent chromium are used but no fluoride is used. However, as a result of our confirmation test, it was found that a satisfactory corrosion resistance could not be reproduced. In addition, Patent Article 4 discloses a treatment method in which 5 to 100 g/L of trivalent chromium, nitrate, an organic acid, and a salt of a metal such as cobalt are used. Since in this method concentrations of chromium and the like are high and the treatment is carried out at an elevated temperature, this method has the advantage that a thick film, and accordingly a good corrosion resistance can be obtained, but the disadvantage that a stable corrosion resistance cannot be obtained because of difficulty in forming a stable and dense film. In addition, the method is also disadvantageous in wastewater treatment since the treatment bath contains chromium in high concentration and a large amount of an organic acid is also used therein. In addition, as to the appearance of the film, only colorless and interference-color appearance can be obtained. In this connection, as to formation of a black trivalent chromium chemical conversion coating film on zinc-nickel (Ni % in the film is 8% or more) or zinc-iron, Patent Article 5 discloses a treatment method with an aqueous acidic solution containing a phosphorus acid compound and trivalent chromium. Meanwhile, as to formation of an interference-color trivalent chromium chemical conversion coating film on zinc-nickel (Ni % in the film is 8% or more), Patent Article 6 discloses a treatment method with an aqueous acidic solution likewise containing a phosphorus compound, trivalent chromium, and additionally halate ions. However, the Ni codeposition rate of much of actually produced zinc-nickel alloy plating falls below 8%, and thus these method have practical problems in obtaining a black appearance. Meanwhile, regarding zinc-iron alloy plating, a sufficient corrosion resistance has not been provided.

The treatment solution disclosed in Patent Article 7 developed by the present inventors provide a good black appearance and a good corrosion resistance more than comparable to chromate using hexavalent chromium. In addition, the present inventors evaluate that the treatment solution in Patent Article 8 or Patent Article 9 provides a poorer corrosion resistance but a better black appearance than conventional black chromate. However, these chemical conversion treatment solutions each have a problem of having a short treatment bath life since the treatment solution provides a reduced black appearance as zinc ions become accumulated in the treatment solution by being dissolved from zinc or zinc alloy on the surface of the treated substrate through chemical conversion treatment of the zinc or zinc alloy.

Patent Article 1: Japanese Examined Patent Application Publication No. Sho 63-015991;

Patent Article 2: Japanese Patent Application Publication No. Hei 10-183364;

Patent Article 3: Japanese Patent Application Publication No. 2000-54157;

Patent Article 4: Japanese Patent Application Publication No. 2000-509434;

Patent Article 5: U.S. Pat. No. 5,415,702;

Patent Article 6: U.S. Pat. No. 5,407,749;

Patent Article 7: Japanese Patent Application Publication No. 2003-268562;

Patent Article 8: Japanese Patent Application Publication No. 2005-187925; and

Patent Article 9: Japanese Patent Application Publication No. 2005-206872.

DISCLOSURE OF THE INVENTION

Problems that the Invention is to Solve

An object of the present invention is to provide: a treatment solution for forming, on the zinc or zinc alloy surface, a hexavalent chromium-free trivalent chromium chemical conversion coating film with a uniform black appearance and a good corrosion resistance, the treatment solution having a longer treatment bath life; and a method for forming the black trivalent chromium chemical conversion coating film.

Means for the Solution of the Problems

To solve the above problems, the present inventors have made a thorough examination and found that a hexavalent chromium-free trivalent chromium chemical conversion coating film with a uniform black appearance and a good corrosion resistance can be formed on the zinc or zinc alloy surface and that such performance of a treatment bath can be maintained stable over a long period by having an aqueous treatment solution for trivalent chromium chemical conversion not containing hexavalent chromium to include a phosphate ester and/or a phosphite ester and a sulfur compound. As a result, the present inventors have completed the present invention. Specifically, the present invention provides an aqueous treatment solution for forming a black trivalent chromium chemical conversion coating film on zinc or zinc alloy, the solution comprising: a trivalent chromium ion; a phosphate ester and/or a phosphite ester; and a sulfur compound.

In addition, the present invention provides a chemical conversion treatment method for zinc or zinc alloy, the method comprising the step of forming a black trivalent chromium chemical conversion coating film on zinc or zinc alloy by performing a chemical conversion treatment on the zinc or zinc alloy by using the aqueous treatment solution at a solution temperature of 10 to 60° C.

Furthermore, the present invention also provides a metal coated with zinc or zinc alloy having a black trivalent chromium chemical conversion coating film formed by performing a chemical conversion treatment on the zinc or zinc alloy with the aqueous treatment solution.

Effect of the Invention

The present invention makes it possible to form a hexavalent chromium-free black trivalent chromium chemical conversion coating film having excellent black appearance and corrosion resistance, and having uniform and stable black and bright appearance and corrosion resistance. Moreover, the chemical conversion treatment solution according to the present invention is an aqueous solution for a chemical conversion treatment bath achieving low reduction in blackness, having a longer life and containing trivalent chromium in a low concentration to be advantageous in wastewater treatment and thus has a good cost performance.

BRIEF DESCRIPTION OF DRAWINGS

FIG. 1 shows the range of the ratio of the sulfur compound concentration D to the zinc concentration in the case where the trivalent chromium concentration in the treatment solution is 0.08 mol/L.

BEST MODE FOR CARRYING OUT THE INVENTION

The substrate used in the present invention may be made of any of the following materials: various metals such as iron, nickel and copper; alloys thereof; and metals and alloys such as aluminum, which have been subjected to zincate conversion treatment, and may have any of various shapes such as plate-like, rectangular, column-like, cylindrical and spherical shapes.

The above substrate is plated with zinc or a zinc alloy by the usual method. The zinc plating may be deposited on the substrate using either of the following baths: an acidic/neutral bath such as a sulfuric acid bath, a borofluoride bath, a potassium chloride bath, a sodium chloride bath or an ammonium chloride-potassium chloride bath; or an alkaline bath such as a cyanide bath, a zincate bath or a pyrophoric acid bath, but particularly, a cyanide bath is preferable. The zinc alloy plating may be performed using either an ammonium chloride bath or an alkaline bath such as an organic chelate bath.

In addition, the zinc alloy plating may be zinc-iron alloy plating, zinc-nickel alloy plating, zinc-cobalt alloy plating or tin-zinc alloy plating, but zinc-iron alloy plating is preferable. The zinc or zinc alloy plating may be deposited on a substrate in any thickness, but preferably in the thickness of 1 μm or more, and more preferably in the thickness of 5 to 25 μm.

In the present invention, after the zinc or zinc alloy plating is deposited on a substrate according to the above method, the plated substrate is appropriately pretreated by, for example, being washed with water and optionally activated by a nitric acid, as needed. Thereafter, the zinc or zinc alloy plating is subjected to chemical conversion treatment by a dipping treatment or the like using a treatment solution for forming a black trivalent chromium chemical conversion coating film according to the present invention.

The aqueous treatment solution for forming a black trivalent chromium chemical conversion coating film on a zinc or zinc alloy according to the present invention contains: trivalent chromium ions; a phosphate ester and/or a phosphite ester; and a sulfur compound.

In the aqueous treatment solution of the present invention, any chromium compound containing trivalent chromium ions may be used as a source of trivalent chromium ions. However, the source should preferably be a trivalent chromium salt such as chromium chloride, chromium sulfate, chromium nitrate, chromium phosphate or chromium acetate, or, alternatively, trivalent chromium ions can be obtained by the reduction of hexavalent chromium ions of chromic acid, dichromic acid and the like with a reducing agent. The especially preferable source of trivalent chromium ions is chromium nitrate. One of the above sources of trivalent chromium ions or any combination of at least two of them may be used. The concentration of trivalent chromium ions in the treatment solution is not limited from the viewpoint of its performance, but should preferably be as low as possible from the viewpoint of the wastewater treatment. Therefore, the concentration of trivalent chromium ions in the treatment solution should preferably be in the range of 0.01 to 0.3 (mol/L) [0.5 to 15 (g/L)] and more preferably 0.02 to 0.2 (mol/L) [1 to 10 (g/L)], in consideration of the corrosion resistance and the like. In the present invention, the use of trivalent chromium in such a low concentration is advantageous from the viewpoint of the wastewater treatment and the cost.

The phosphate ester used in the aqueous treatment solution according to the present invention should preferably be an alkyl phosphate, and particularly preferably be a trialkyl phosphate. Specific examples of such esters include a trimethyl phosphate, a triethyl phosphate and a tributyl phosphate. Meanwhile, the phosphite ester should preferably be an alkyl phosphite, and particularly preferably be a dialkyl phosphite or a trialkyl phosphite. Specific examples of such esters include a phosphorous acid trimethyl ester, a phosphorous acid diethyl ester and a phosphorous acid triethyl ester. The concentration of the phosphate ester and/or the phosphite ester in the treatment solution should preferably be 0.005 to 0.55 (mol/L), more preferably be 0.01 to 0.3 (mol/L), and still more preferably be 0.03 to 0.15 (mol/L). One of the above esters or a mixture of two or more of them can be used herein. The use of the phosphate ester and/or the phosphite ester in a concentration within the above range is preferable since this allow the performance of the treatment bath to be maintained stable over a long period.

The sulfur compound used in the treatment solution according to the present invention may be either an inorganic sulfur compound or an organic sulfur compound, but should preferably be an organic sulfur compound. Examples of inorganic sulfur compounds include compounds such as sodium sulfide, potassium sulfide, ammonium sulfide, calcium sulfide, sodium thiosulfate and sodium in hydrogensulfide. Specific examples of organic sulfur compounds include: thioureas such as thiourea, allylthiourea, ethylene thiourea, diethylthiourea, diphenylthiourea, tolylthiourea, guanylthiourea and acetylthiourea; mercaptans such as mercaptoethanol, mercaptohypoxanthine, mercaptobenzimidazole and mercaptobenzthiazole; thiocyanic acid and salts thereof; amino compounds such as aminothiazole; thiocarboxylic acids such as thioformic acid, thioacetic acid, thiomalic acid, thioglycolic acid, thiodiglycolic acid, thiocarbamic acid and thiosalicyclic acid; salts of these thiocarboxylic acids; dithiocarboxylic acids such as dithioformic acid, dithioacetic acid, dithioglycolic acid, dithioglycolic acid and dithiocarbamic acid; and salts of these thiocarboxylic acids. Among these organic sulfur compounds, thioureas, thiocarboxylic acids, dithiocarboxylic acids and salts thereof are preferable, and particularly, thiourea, thioacetic acid, thioglycolic acid, thiomalic acid, thiomaleic acid, dithioglycolic acid, sodium salts thereof and ammonium salts thereof are more preferable.

The sulfur compound concentration D (mol/L) in the treatment aqueous solution according to the present invention should preferably be any value within the range of 0.0002 to 0.1 (mol/L), and more preferably be any value within the range of 0.001 to 0.07 (mol/L). However, the zinc ion concentration C (mol/L), the trivalent chromium ion concentration A (mol/L), and the sulfur compound concentration D (mol/L) in the aqueous treatment solution should preferably be in the range represented by the following Expression (1), since this allows the performance of the aqueous treatment solution to be maintained stable over a longer period.

$$0.0431C+A/4 \geq D \geq 0.431C+A/50 \quad \text{Expression (1)}$$

At an initial stage (in an initial bath preparation), the aqueous treatment solution according to the present invention may include substantially no zinc ion. However, the aqueous treatment solution may alternatively include zinc ions at an initial stage (in an initial bath preparation). If the aqueous treatment solution may alternatively include zinc ions at an initial stage (in an initial bath preparation), the zinc ion concentration therein should preferably be in the range of 0.002 to 0.2 (mol/L), more preferably be in the range of 0.01 to 0.15 (mol/L), and still more preferably be in the range of 0.02 to 0.1 (mol/L).

In general, the zinc ion concentration increases in the aqueous treatment solution according to the present invention with the progress of the chemical conversion treatment. The zinc ion concentration in the treatment bath need not necessarily be controlled. If controlled, the zinc ion concentration in the treatment bath during treatment should preferably be in the range of 0.002 to 0.60 (mol/L), more preferably be in the range of 0.01 to 0.15 (mol/L), and still preferably be in the range of 0.015 to 0.45 (mol/L). A too high zinc ion concentration in the aqueous treatment solution is not preferable since this causes the chemical conversion coating film to have insufficient corrosion resistance and blackness. The method for measuring zinc ions in order to control the zinc ion concentration during the chemical conversion treatment is not particularly limited, but the zinc ion concentration may be accurately controlled by a known method such as titrimetric analysis, ion plasma spectrometry or atomic absorption spectrometry. The trivalent chromium ion concentration may also be controlled by a similar method.

The treatment solution according to the present invention should preferably include a chelating agent capable of forming a water soluble complex with the trivalent chromium ions. The chelating agent may be: a hydroxycarboxylic acid such as tartaric acid or malic acid; any of monocarboxylic acids other than formic acid and acetic acid; a polyvalent carboxylic acid such as a dicarboxylic acid or a tricarboxylic acid, for example oxalic acid, malonic acid, succinic acid, citric acid or adipic acid or an aminocarboxylic acid such as glycine Note that, among monocarboxylic acids, formic acid and acetic acid are inappropriate as the chelating agent, but may each be added to the treatment solution according to the present invention as needed since these acids each have an effect of promoting blackening as a buffering agent. As the chelating agent, one of the aforementioned acids and salts thereof (e.g. salts of sodium, potassium, ammonia and the like) or any combination of at least two of them may be used. Among these, most preferable chelating agent is oxalic acid. The concentration of the chelating agent in the treatment solution is not limited, but should preferably be in the range of 1 to 40 g/L, and more preferably be in the range of 5 to 35 g/L in total. The molar ratio of the chelating agent to the trivalent chromium ions in the treatment solution according to the present invention [chelating agent concentration (mol/L)/trivalent chromium ion concentration (mol/L)] should preferably be in the range of 0.2 to 4, and more preferably be in the range of 1 to 2. In addition, the method for mixing the trivalent chromium compound and the chelating agent is not particularly limited, but the trivalent chromium compound and the chelating agent may be used after being mixed and heated at a temperature of 60° C. or more in advance so as to facilitate forming a complex, for example.

The reason why the chemical conversion treatment solution according to the present invention allows formation of a hexavalent chromium-free trivalent chromium chemical conversion coating film with a uniform black appearance and a good corrosion resistance, a long-lasting property thereof and an extended bath life is not clear. However, the reason can be assumed to be as follows.

Firstly, hydrogen ions cause zinc in the surface of the substrate metal to dissolve into the treatment solution, and this increases the pH on the surface of the metal to produce a chromium hydroxide thereon. Meanwhile, the reaction of trivalent chromium ions and a sulfur compound produces a black metal sulfide thereon. Then, these metal compounds thus produced form a film, and thereby a black chemical conversion coating film develops. In this reaction, an increase in the zinc concentration in the treatment bath might suppresses the dissolution of the zinc, thus slowing down the formation of a chemical conversion coating, and making it impossible to obtain a good black film. Accordingly, by maintaining the molar ratio of the zinc ion concentration to the sulfur compound within a certain low range, blackening reaction of the trivalent chromium ions and the sulfur compound will progress speedily so that a good film will be obtained even if the zinc concentration increases. Specifically, the molar ratio of the zinc ion concentration to the sulfur compound can be maintained within a certain low range by a method of adding a sulfur compound within a certain range in accordance with a certain concentration of trivalent chromium in the treatment bath and the concentration of zinc ions in the treatment bath increasing through the chemical conversion treatment. Expression (1) proposed in the present invention is an empirical formula obtained as above, and FIG. 1 shows the range of the ratio of the sulfur compound concentration D to the zinc concentration in the case where the trivalent chromium concentration in the treatment solution is 0.08 mol/L.

The additional existence of a chelating agent capable of forming a water soluble complex with trivalent chromium in the above treatment solution will likely suppress the deposition rate of a chromium hydroxide and thus make the coating film denser. Moreover, the additional existence of a phosphate ester and/or a phosphite ester at a certain concentration will likely make the chemical conversion coating film denser and thus improve the corrosion resistance thereof. This is because the phosphate ester and/or the phosphite ester is adsorbed onto the zinc plating surface and thus allows the reactions to proceed at a moderate rate in the deposition process of the black chemical conversion coating film.

The sulfur compound may be supplied to the treatment solution according to the present invention in accordance with the increase in the zinc ion concentration caused by the above chemical conversion treatment. In this case, the sulfur compound should preferably be supplied so that the sulfur compound concentration can fall within the range represented by the above Expression (1) since this allows a good black coating film to be obtained without slowing domain the blackening reaction and extends the bath life.

A specific example of a method of adding a sulfur compound may be a method of adding a supplemental fluid. Such a supplemental fluid needs only to contain a sulfur compound and the composition of the solution is not particularly limited. However, the supplemental fluid may be, for example, an aqueous solution containing:

| | |
|---|---|
| sodium phosphite pentahydrate | 0.005 g/L |
| chromium nitrate | 0.04 g/L |
| sulfur compound | 0.008 g/L. |

In addition, timing of an addition or an amount of such a supplemental fluid is not particularly limited as long as the zinc concentration can fall within the predetermined range, and thus the supplemental fluid may be added intermittently or continuously as needed.

The aqueous treatment solution according to the present invention may include phosphite ions as needed since a buffering effect thereof will likely contribute to the formation of dense coating film. The phosphite ion concentration in the aqueous treatment solution should preferably be in the range of 0.01 to 0.6 (mol/L), should more preferably be in the range of 0.02 to 0.4 (mol/L), and should still more preferably be in the range of 0.3 to 0.2 (mol/L). A source of phosphite ions may be a phosphorous acid or a phosphite such as sodium phosphite or potassium phosphite, for example.

The aqueous treatment solution according to the present invention may further contain metal ions other than trivalent chromium ions. Such metal ions may be monovalent to hexavalent metal ions, but preferably metal ions are ions of cobalt, nickel, silicon iron, titanium, zirconium, tungsten, molybdenum, strontium, niobium, tantalum, manganese, calcium, magnesium, aluminum and the like, and more preferably metal ions are cobalt ions, nickel ions and iron ions. The aqueous treatment solution may contain one or more kinds of metal ions selected from these metal ions. Such metal ions may be contained in the treatment solution at any concentration, but should preferably be contained as cations at a concentration in the range of 0.1 to 50 g/L, and more preferably in the range of 0.5 to 20 g/L in total. A source of such metal ions may be chlorides, nitrates, sulfates, acetates, oxoates or the like of the metal ions.

In addition, one or more kinds of inorganic acid ions selected from the group consisting of ions of any of phosphorus oxoacids other than phosphorous acid, chloride ions, nitrate ions and sulfate ions may be added into the aqueous treatment solution according to the present invention. By adding such inorganic acid ions, a good black appearance can be obtained on the zinc or zinc alloy plating. A source of phosphorus oxoacid ions may be a phosphorus oxoacid such as phosphoric acid or hypophosphorous acid, or a salt thereof. A source of chloride ions may be hydrochloric acid or a chloride salt such as sodium chloride or potassium chloride. A source of sulfate ions may be a sulfurous oxoacid such as sulfuric acid or sulfurous acid, or a salt thereof. A source of nitrate ions may be nitric acid, nitrous acid or the like, or a salt thereof. In the aqueous treatment solution according to the present invention, a mixture of two or more of the above acids and salts thereof can also be used. The concentration of the inorganic acid ions in the treatment solution is not limited, but should preferably be in the range of 1 to 150 g/L, and more preferably be in the range of 5 to 80 g/L in total.

The pH of the treatment solution according to the present invention should preferably be 0.5 to 4, more preferably 1 to 3. The pH can be adjusted to this range by using the above inorganic acid, an organic acid, an alkaline hydroxide, ammonia water or the like. In addition, the aqueous treatment solution according to the present invention may include various known additional ingredients for chemical conversion treatment solution such as surfactants and stabilizers, as needed.

A black trivalent chromium chemical conversion coating film is formed on the zinc or zinc alloy plating through the chemical conversion treatment of the zinc or zinc alloy plating using the above treatment solution according to the present invention by, for example, immersing the zinc or zinc alloy plating into the treatment solution. A temperature of the treatment solution should preferably be in the range of 10 to 60° C. and more preferably be in the range of 20 to 40° C. An immersing time into the treatment solution should preferably be in the range of 5 to 600 seconds and more preferably be in the range of 20 to 120 seconds. In this connection, the zinc or zinc alloy plating may be immersed into a dilute nitric acid solution in order to activate the zinc or zinc alloy plating surface, before the trivalent chromium chemical conversion treatment. The conditions and treatment operations other than those described above may follow the conventional hexavalent chromium treatment method. In addition, after the trivalent chromium chemical conversion treatment according to the present invention, the zinc or zinc alloy may be washed with water immersed in a solution containing chromic phosphate or a finishing liquid containing chromic phosphate and zinc and/or a resin, and dried without being washed with water. This makes it possible to form the black film with still better corrosion resistance.

Meanwhile, overcoating the trivalent chromium chemical conversion coating film can improve the corrosion resistance thereof, and thus is a highly effective means for achieving longer-lasting corrosion resistance. For example, the zinc or zinc alloy plating may be firstly subjected to the above trivalent chromate treatment, then washed with water, then immersed into an overcoating solution or subjected to an electrolytic treatment therein, and thereafter dried. Alternatively, the zinc or zinc alloy plating may be dried after the trivalent chromate treatment, and thereafter further immersed into an overcoating solution or subjected to an electrolytic treatment therein, and then dried. Here, as the overcoating, as well as an inorganic film made of silicates, phosphates or the like, an organic film made of polyethylene, polyvinyl chloride, polystyrene, polypropylene, methacrylate resin, polycarbonate, polyamide, polyacetal, fluorine resin, urea resin, phenolic resin, unsaturated polyester resin, polyurethane resin, alkyd resin, epoxy resin, melamine resin or the like may be effectively used. As the overcoating solution for overcoating such a film, DIPCOAT W or CC445 available from Dipsol Chemicals Co., Ltd. or the like may be used. The thickness of the overcoating may be any value, but should preferably be 0.1 to 30 μm.

EXAMPLES

Examples 1 to 5 and Comparative Examples 1 to 3

A steel plate, which had been plated with zinc in a thickness of 8 μm using a zincate bath containing NZ-98 available from Dipsol Chemicals Co., Ltd., was immersed in a treatment solution for trivalent chromium chemical conversion as shown in Table 1.

TABLE 1

| | Example 1 | Example 2 | Example 3 | Example 4 | Example 5 | Comparative Example 1 | Comparative Example 2 | Comparative Example 3 |
|---|---|---|---|---|---|---|---|---|
| $Cr^{3+}$ (g/L) | 4.5 | 4.5 | 4.5 | 4.5 | 4.5 | 4.5 | 4.5 | 4.5 |
| Triethyl Phosphate (g/L) | 10 | 20 | 10 | 10 | 10 | 0 | 0 | 0 |
| Dithiodiglycolic acid (g/L) | 1.5 | 1.5 | 2 | 1.5 | 3 | 1.5 | 2 | 1.5 |
| Sodium phosphite pentahydrate (g/L) | 0 | 0 | 5 | 10 | 15 | 0 | 10 | 0 |
| Oxalic acid (g/L) | 15 | 15 | 15 | 15 | 15 | 15 | 0 | 15 |
| Cobalt nitrate hexahydrate (g/L) | 5 | 5 | 5 | 5 | 5 | 5 | 5 | 5 |
| Succinic acid (g/L) | 0 | 2 | 2 | 0 | 0 | 0 | 2 | 0 |
| Formic acid (g/L) | 3 | 0 | 0 | 0 | 3 | 3 | 0 | 3 |
| $Zn^{2+}$ (g/L) | 0 | 5 | 0 | 5 | 10 | 0 | 0 | 10 |
| pH of treatment solution | 1.9 | 1.9 | 1.9 | 2.0 | 1.9 | 1.9 | 1.8 | 1.9 |
| Treatment temperature (° C.) | 30 | 30 | 25 | 25 | 30 | 30 | 30 | 30 |
| Treatment time (sec) | 60 | 60 | 60 | 60 | 60 | 60 | 60 | 60 |

In the above table, chromium nitrate was employed as a source of $Cr^{3+}$, and the rest of the solution was water.

Examples 6 to 9

After the trivalent chromium chemical conversion treatments of Examples 1 to 3, finishing or overcoating is performed. Table 2 shows the treatment conditions thereof.

TABLE 2

| | Example 6 | Example 7 | Example 8 | Example 9 |
|---|---|---|---|---|
| Trivalent chromium chemical conversion treatment | Example 1 | Example 2 | Example 3 | Example 3 |
| Kind of finishing or overcoating liquid | chromic phosphate-based finishing liquid | chromic phosphate-based finishing liquid | chromic phosphate-based, finishing liquid + methacrylate resin-based finishing liquid | methacrylate resin-based organic coating |
| Treatment concentration | 20 ml/l | 20 ml/l | ZTB-118: 15 ml/l DIPCOAT W: 100 ml/l | undiluted solution is used |
| Treatment condition | 50° C. - 10 sec | 50° C. - 10 sec | 25° C. - 10 sec | 25° C. - 60 sec |
| Brand name of chemical | ZTB-118 available from Dipsol Chemicals Co., Ltd. | ZTB-118 available from Dipsol Chemicals Co., Ltd. | mixture of ZTB-118 + DIPCOAT W both available from Dipsol Chemicals Co., Ltd. | DIPCOAT W available from Dipsol Chemicals Co., Ltd |

Comparative Example 4

A steel plate, which had been plated with zinc in a thickness of 8 μm, was subjected to a hexavalent chromate treatment. As the hexavalent chromate, ZB-535A (200 ml/l) and ZB-535B (10 ml/l) both available from Dipsol Chemicals Co., Ltd. were used.

(Result)

Table 3 shows the appearances and salt spray test (JIS-Z-2371) results of the zinc plating obtained in Examples 1 to 9 and Comparative Examples 1 to 4.

As shown in Table 3, the coating films obtained in Examples 1 to 5 exhibited improved corrosion resistances over those in Comparative Examples 1 to 3 while the coating films obtained in Examples 6 to 9 exhibited corrosion resistance comparable or superior to the conventional hexavalent black chromate coating film obtained in Comparative Example 4.

TABLE 3

Salt Spray Test Results (JIS-Z-2371)

| | Appearance of coating film | Corrosion Resistance Time required for the formation of white/red rusts (5% by mass) (Hrs) |
|---|---|---|
| Example 1 | Black | 72/400 |
| Example 2 | Black | 96/400 |
| Example 3 | Black | 96/400 |
| Example 4 | Black | 120/500 |
| Example 5 | Black | 120/500 |
| Example 6 | Black | 120/500 |
| Example 7 | Black | 240/500 |
| Example 8 | Black | 300/500 |
| Example 9 | Black | 300/1000 |

TABLE 3-continued

Salt Spray Test Results (JIS-Z-2371)

| | Appearance of coating film | Corrosion Resistance Time required for the formation of white/red rusts (5% by mass) (Hrs) |
|---|---|---|
| Comparative Example 1 | Black | 24/500 |
| Comparative Example 2 | Interference color | 24/250 |

TABLE 3-continued

Salt Spray Test Results (JIS-Z-2371)

| | Appearance of coating film | Corrosion Resistance Time required for the formation of white/red rusts (5% by mass) (Hrs) |
|---|---|---|
| Comparative Example 3 | Interference color | 24/250 |
| Comparative Example 4 | Black | 120/250 |

The invention claimed is:

1. An aqueous treatment solution for forming a black trivalent chromium chemical conversion coating film on zinc or zinc alloy, the solution comprising:

a trivalent chromium ion in the range of 0.01 to 0.3 mol/L;

a trialkyl phosphate selected from the group consisting of trimethyl phosphate, triethyl phosphate and tributyl phosphate in the range of 0.01 to 0.3 mol/L;

an organic sulfur compound in the range of 0.001 to 0.07 mol/L; and a chelating agent capable of forming a water soluble complex with the trivalent chromium ion.

2. A chemical conversion treatment method for zinc or zinc alloy, the method comprising the step of forming a black trivalent chromium chemical conversion coating film on zinc or zinc alloy by performing a chemical conversion treatment on the zinc or zinc alloy by using the aqueous treatment solution according to claim 1 at a solution temperature of 10 to 60° C.

3. A method for improving a corrosion resistance of a black trivalent chromium chemical conversion coating film formed on zinc or zinc alloy using an aqueous treatment solution, comprising adding a trialkyl phosphate selected from the group consisting of trimethyl phosphate, triethyl phosphate and tributyl phosphate in the range of 0.01 to 0.3 mol/L to the aqueous treatment solution:

wherein the aqueous treatment solution contains:

a trivalent chromium ion in the range of 0.01 to 0.3 mol/L;

an organic sulfur compound in the range of 0.001 to 0.07 mol/L; and a chelating agent capable of forming a water soluble complex with the trivalent chromium ion.

* * * * *